US011639586B1

(12) United States Patent
Rodriguez

(10) Patent No.: US 11,639,586 B1
(45) Date of Patent: May 2, 2023

(54) WALKWAY PAVER

(71) Applicant: Joe Rodriguez, Brandon, FL (US)

(72) Inventor: Joe Rodriguez, Brandon, FL (US)

( * ) Notice: Subject to any disclaimer, the term of this patent is extended or adjusted under 35 U.S.C. 154(b) by 217 days.

(21) Appl. No.: 17/116,769

(22) Filed: Dec. 9, 2020

(51) Int. Cl.

| | |
|---|---|
| ***E01C 5/00*** | (2006.01) |
| ***E01C 17/00*** | (2006.01) |
| ***F21V 23/06*** | (2006.01) |
| ***F21V 33/00*** | (2006.01) |
| ***E01C 5/22*** | (2006.01) |
| *F21Y 115/10* | (2016.01) |

(52) U.S. Cl.
CPC ..... *E01C 17/00* (2013.01); *E01C 5/001* (2013.01); *E01C 5/223* (2013.01); *F21V 23/06* (2013.01); *F21V 33/006* (2013.01); *F21Y 2115/10* (2016.08)

(58) Field of Classification Search
CPC ..... E01C 5/001; E01C 5/226; E01C 17/00; F21V 23/06; F21V 33/006; F21Y 2115/10
USPC ..... 404/34–36, 43
See application file for complete search history.

(56) References Cited

U.S. PATENT DOCUMENTS 3,732,020 A * 5/1973 Judge ..... E01C 5/20 404/19
4,490,069 A * 12/1984 Cushman ..... E01F 9/529 404/15
4,681,481 A 7/1987 Kapusta
4,697,294 A * 10/1987 Schafer ..... E01C 5/005 404/35
4,746,263 A * 5/1988 Cook ..... B60P 1/549 212/304
5,364,204 A * 11/1994 MacLeod ..... A63C 19/12 52/180
5,409,325 A 4/1995 Wu
6,171,015 B1 * 1/2001 Barth ..... E01C 5/001 404/34
2003/0090896 A1 * 5/2003 Sooferian ..... E01C 17/00 362/276
2006/0231131 A1 * 10/2006 Hain ..... F21S 9/037 136/291
2007/0263381 A1 * 11/2007 Goldman ..... F21S 9/032 362/183
2007/0269265 A1 * 11/2007 Thorkelson ..... E01C 5/18 404/34
2011/0013384 A1 * 1/2011 Lu ..... F21S 8/022 362/183

(Continued)

*Primary Examiner* — Raymond W Addie
(74) *Attorney, Agent, or Firm* — Sanchelima & Associates, P.A.; Christian Sanchelima; Jesus Sanchelima

(57) ABSTRACT

A walkway paver including a paver assembly and an attaching assembly is disclosed. The paver assembly includes a paver, preferably made of fiber glass, that is filled with one of water, sand or combinations thereof. Each paver may include a filling opening that leads to an interior of the paver and also allows for easy refilling of the paver. The filling opening is sealed with a plug. Each paver may be interconnected with additional pavers in order to create a walkway. Each paver further includes lights which are used to illuminate the vicinity of the paver and the walkway created for added safety. The attaching assembly importantly includes a threaded fastener that extends centrally through each paver. The threaded fastener extends a predetermined distance into a ground surface to secure each paver in place.

14 Claims, 3 Drawing Sheets

(56) References Cited

U.S. PATENT DOCUMENTS

| | | | | |
|---|---|---|---|---|
| 2012/0114415 | A1* | 5/2012 | Blocken | E01C 17/00<br>362/183 |
| 2014/0270945 | A1* | 9/2014 | Bach | E01C 9/086<br>404/36 |

* cited by examiner

WALKWAY PAVER

BACKGROUND OF THE INVENTION

1. Field of the Invention

The present invention relates to a walkway paver and, more particularly, to a walkway paver that is secured to a ground surface to create a walkway and further illuminates the walkway created.

2. Description of the Related Art

Several designs for walkway pavers have been designed in the past. None of them, however, include a walkway paver or landscaping stone which is made from a fiberglass material and is hollow wherein the stone could have an internal light for illuminating the paver at night or be filled with water for ornamental purposes. The present invention allows for a walkway or pathway to be created and further be illuminated for added safety to the user, especially at night. Further, the present invention allows the user to improve the aesthetics of their homes with lights and water, which form a part of the walkway pavers.

Applicant believes that a related reference corresponds to U.S. Pat. No. 5,409,325, for a walkway paver made from a composite vinyl material. Applicant believes that another related reference corresponds to U.S. Pat. No. 4,681,481 for a decorative functional construction element, such as a paver or block, which can be made from fiberglass. None of these references, however, teach of hollow and fiberglass walkway pavers that include illuminating members to illuminate a walkway created by the landscaping stones. Further, the present invention has the ability of being filled with water for added ornamental purposes.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a walkway paver which are interconnected with multiple other walkway pavers to create a walkway or pathway.

It is another object of this invention to provide a walkway paver that can improve the safety of the user by providing visibility of the walkway created, even at night.

It is still another object of the present invention to provide a walkway paver that improves the aesthetics or ornamentation of a surrounding area to where the walkway pavers are installed.

It is also another object of the present invention to provide a walkway paver that is customizable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
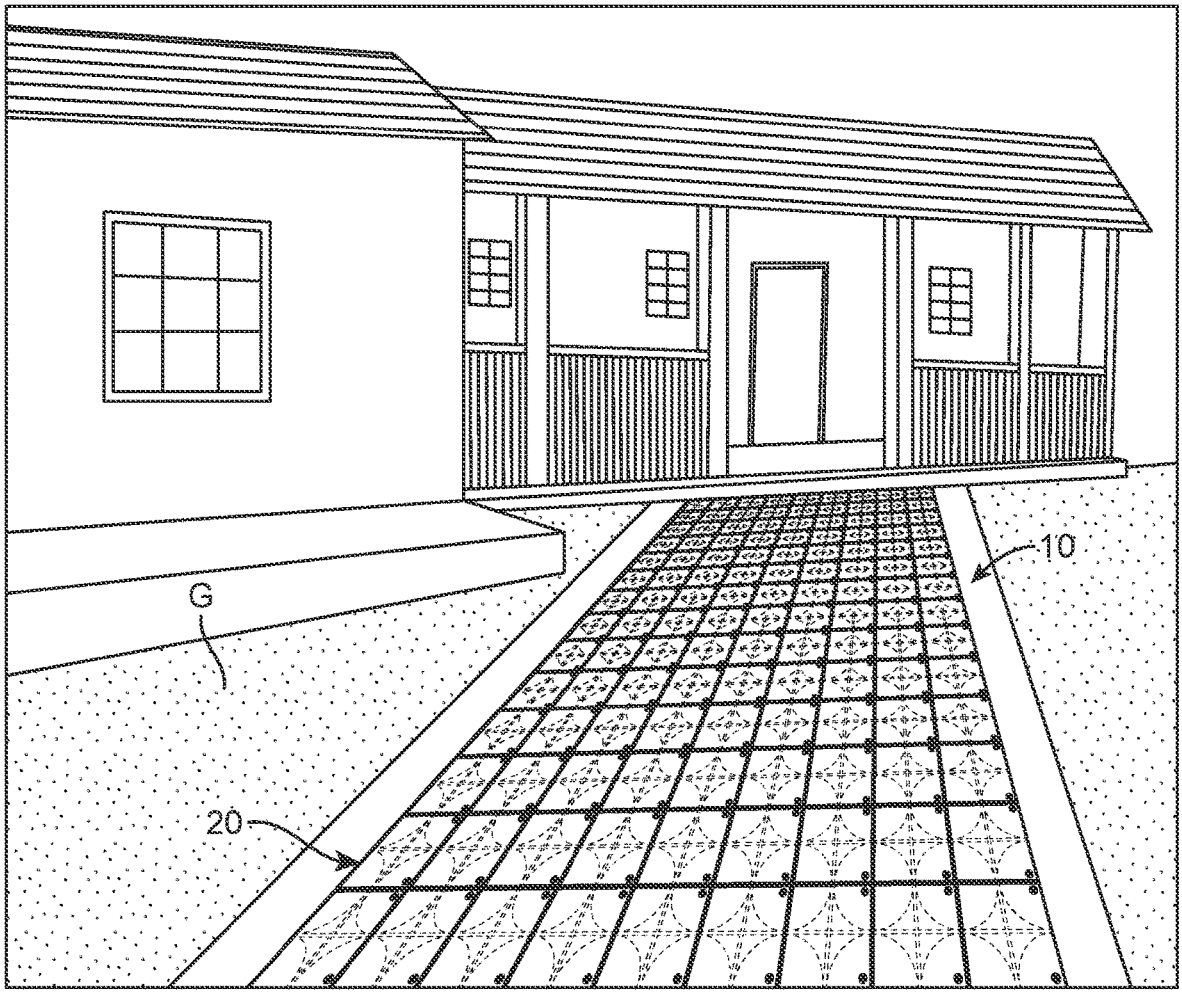
FIG. 1 represents an operational setting in which multiple of walkway paver 10 are interconnected to create a walkway.

Referring now to the drawings, where the present invention is generally referred to with numeral 10, it can be observed that it, walkway paver 10, basically includes paver assembly 20 and attaching assembly 40.

When beautifying a location and the surrounding area, there are often pathways or walkways created by landscaping stones that are oriented in a manner that leads to a point of interest. The present invention facilitates and improves on the walkways or pathways created. Additionally, the present invention is capable of being visible and providing visibility to the surrounding area.

Figure 2:
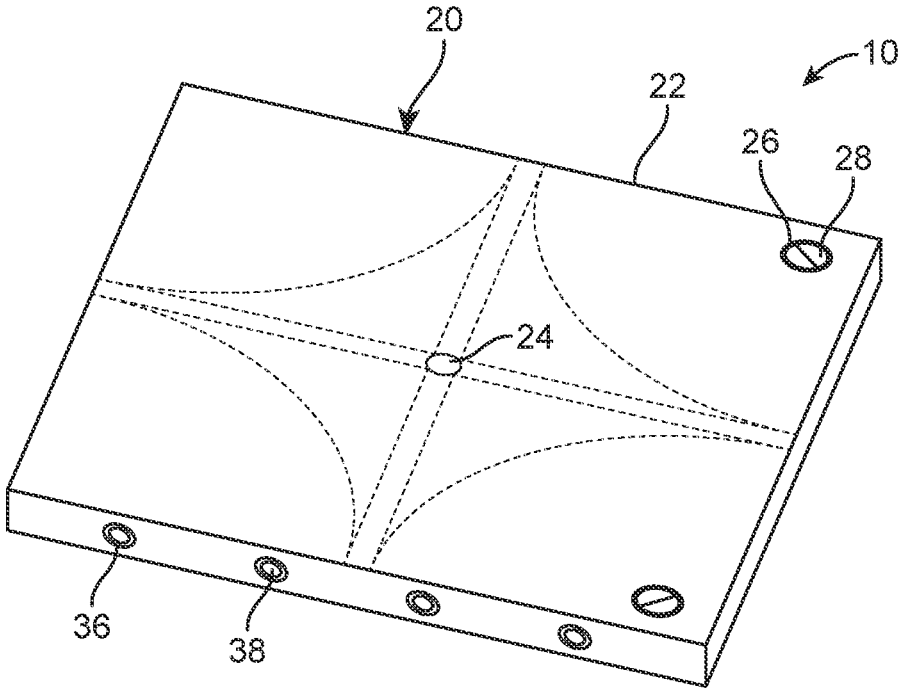
FIG. 2 shows an isometric view of the walkway paver 10.

Multiple of walkway paver 10 may be interconnected to create a walkway or pathway, as best seen in FIG. 1. Paver assembly 20 may assist in creating the walkway. Paver assembly 20 includes a paver 22, as best seen in FIG. 2. Multiple of paver 22 may be interconnected in a predetermined configuration or design as desired by the user. Paver 22 may preferably be made of fiberglass. Preferably, solid fiberglass. Each of paver 22 may also, preferably, be substantially hollow. It may be suitable for each paver 22 to be either transparent, semitransparent or opaque. It is to be understood that each of paver 22 may be in a predetermined color and design. Paver 22 may be customizable as desired. There may be saying, logos, engravings, phrases, or images mounted on paver 22. Paver 22 may also be rectangular, in one embodiment. However, it may be suitable for paver 22 to be of any other predetermined shape. In order to complete the walkway, multiple of paver 22 may be secured to each other and to a ground surface G as well.

Figure 3:
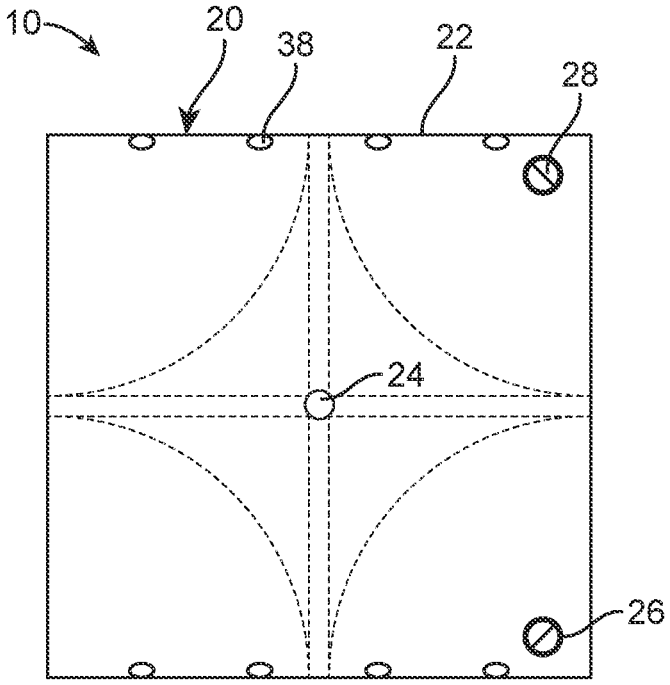
FIG. 3 illustrates a top view of the paver 22.

As best seen in FIG. 3, paver 22 may include a central opening 24 extending therethrough. Central opening 24 may facilitate securing of each of paver 22 to attaching assembly 40 and further ground surface G. Central opening 24 may extend vertically and entirely through paver 22. It is to be understood that while, central opening 24 may be centrally located on paver 22, it may be suitable for central opening 24 to extend through other predetermined locations through paver 22. Central opening 24 may preferably be circular, but other predetermined shapes may be suitable for central opening 24.

Paver 22 may preferably be hollow in order to allow filling of paver 22 with water, sand, other suitable materials or combinations thereof. It may be desired that materials used to fill pavers 22 be visible for ornamental purposes. To be able to fill paver 22 with desired materials, paver 22 may include a filling opening 26, as seen in FIG. 3. In one embodiment, filling opening 26 may be circular, however, other predetermined shapes may be suitable for filling opening 26. It should be understood that filling opening 26 simply leads to an interior of paver 22. It may be suitable for filling opening 26 to be at a predetermined location on paver 22. To prevent the materials inserted into paver 22 from being released, filling opening 26 may be cover by a plug 28. Plug 28 may cooperate with the dimensions and shape of filling opening 26. In one embodiment, filling opening 26 and plug 28 may be threaded to better secure plug 28 into filling opening 26. In an alternate embodiment, plug 28 may simply be inserted into filling opening 26. Plug 28 maintains materials inserted into paver 22 within paver 22. It may be suitable for plug 28 to include a grip portion that may be used when it is necessary to remove plug 28 from filling opening 26 to expose filling opening 26.

Extending about an entire perimeter of paver 22 may be a connection surface 32, as best seen in FIG. 3. Connection surface 32 may facilitate mounting of additional of paver 22 together. Connection surface 32 may further be adapted for added and better securement of paver 22 to ground surface G. Some portions of connection surface 32 may extend vertically along the perimeter of paver 22. Other portions of connection surface 32 may extend horizontally along the perimeter of paver 22. Select corners of connection surface 32 may be cut to allow connecting of other connection surface 32 together to mount multiple of paver 22 together. That is, connection surface 32 may include angle cuts 34. At least two of angle cuts 34 may be interconnected to connect at least two of paver 22 together.

Figure 5:
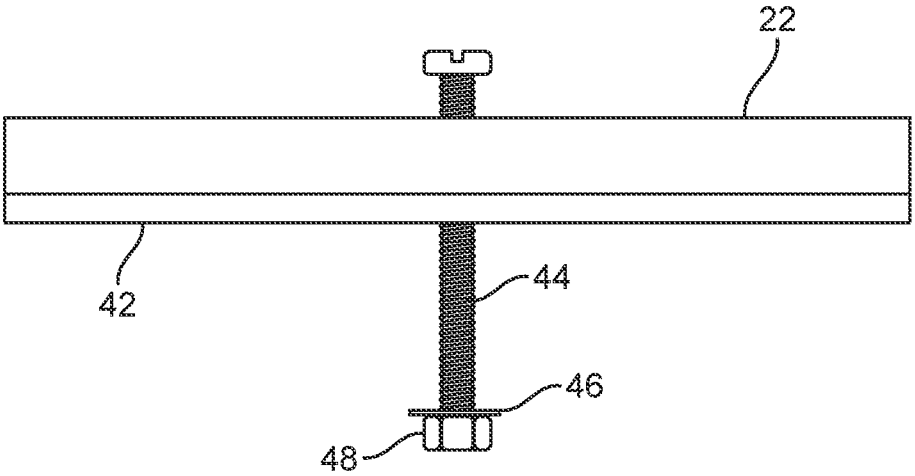
FIG. 5 is a representation of a side view of the paver 22 secured to the ground surface G with the attaching assembly 40.

Extending about the perimeter of paver 22 may be light connectors 36, as seen in FIG. 5. Light connectors 36 may be perpendicular to paver 22, in one embodiment. Lights 38 may be connected to light connectors 36. Light connectors 36 may be connected to a power source in order to supply power to lights 38. Lights 38 may be oriented or mounted in a predetermined configuration on paver 22. It may be possible for paver 22 to further be customizable by having the position and orientation of lights 38 be customizable as desired by the user. In one embodiment, lights 38 may be LED lights or light strips which supply a steady light. Lights 38 may be of a predetermined color or intensity. In one embodiment, it may be suitable for lights 38 to flash. It may be suitable for lights 38 to be controlled by a user either remotely or locally. Lights 38 may assist in improving the safety of those who walk on paver 10. Lights 38 may do more than just provide decoration. Lights 38 may provide visibility, especially at night, by illuminating paver 22 and the surrounding area. In one embodiment, walkway paver 10 may include solar panels to provide power to lights 38.

Figure 4:
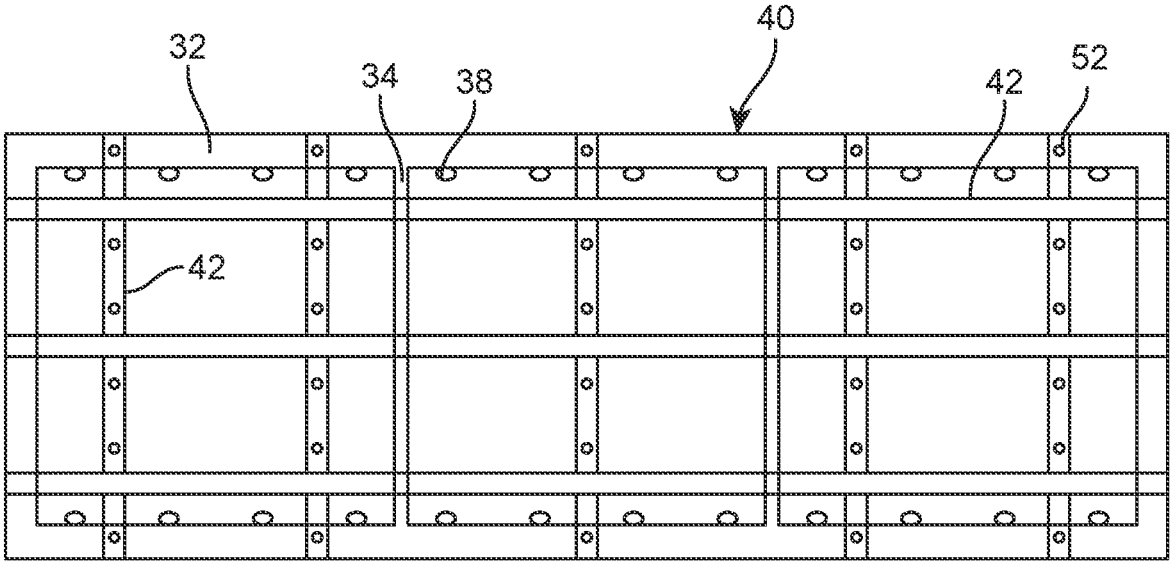
FIG. 4 illustrates a top view of the attaching assembly 40 assembled on a ground surface G to secured walkway paver 10 to the attaching assembly 40.

Attaching assembly 40 may be best seen in FIG. 4 and FIG. 5. Attaching assembly 40 may be mounted onto ground surface G. Attaching assembly 40 may include beams 42. Beams 42 may preferably be fiberglass beams. Beams 42 may be oriented latitudinally and longitudinally on ground surface G. Beams 42 may create multiple cross configurations. It should be understood that at least one cross configuration may be achieved with beams 42. In one embodiment, beams 42 may all be on one same plane. In an alternate embodiment, beams 42 may be mounted atop each other. That is, beams 42 oriented latitudinally may be mounted underneath of beams 42 oriented longitudinally, or vice versa. Beams 42 may provide a base or foundation for each of paver 42 to be secured thereto. Paver 22 may be mounted atop of beams 42 on ground surface G. More specifically, paver 22 may be mounted atop of beams 42 so that central opening 24 is directly on one of beams 42. A threaded fastener 44 may then be inserted through central opening 24 and one of beams 42. Threaded fastener 44 may continue to extend through one of beams 42 and be inserted a predetermined distance into ground surface G, as best seen in FIG. 5. Threaded fastener 44 may include a washer 46 and a nut 48, at a distalmost end, which may be used to further secure threaded fastener 44 to ground surface G with beams 42. Threaded fastener 44 allows for each of paver 22 to be secured to ground surface G. Thereby increasing the safety of anyone in the vicinity of paver 22. Paver 22 is less likely to lift off the ground during hurricanes, theft or other such events that may lead to paver 22 being lifted if not secured with threaded fastener 44. When secured properly to ground surface G, paver 22 may withstand harsh weather conditions such as hurricanes and tornadoes.

Paver 22 may be further secured to beams 42. Connection surface 32 of each of paver 22 may be mounted onto and across beams 42. Through connection surface 32 may extend connecting fasteners 52 which further secure paver 22 in place. Connecting fasteners 52 may be used to secure connection surface 32 to beams 42. Connecting fasteners 52 extend through both of connection surface 32 and beams 42. Further, each of paver 22 may be mounted and secured to each other. Angle cuts 34 may be cooperate with one another to connect one of paver 22 flushly with another of paver 22 until a pathway or walkway is created and defined.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a walkway, comprising:

a) a paver assembly including a paver with a central opening extending therethrough, said paver including light connectors, lights attached to said light connectors to selectively illuminate said paver, wherein said paver includes a filling opening leading to an interior of said paver, wherein said filling opening is selectively sealed with a plug; and b) an attaching assembly secured to a ground surface, said attaching assembly including beams placed on said ground surface, said paver mounted atop of said beams such that said central opening is aligned with one of said beams, a threaded fastener extending through said central opening and said beams and a predetermined distance into said ground surface to secure said paver to said ground surface.

2. The system of claim 1, wherein said paver and said beams are made of fiberglass.

3. The system of claim 1, wherein said paver is substantially hollow.

4. The system of claim 1, wherein said paver is transparent, semitransparent or opaque.

5. The system of claim 1, wherein said paver is customizable in design, shape and color.

6. The system of claim 1, wherein said beams are placed latitudinally and longitudinally on said ground surface to achieve multiple cross configurations.

7. The system of claim 1, wherein said paver is filled with one of water or sand through said filling opening.

8. The system of claim 1, wherein said central opening and said filling opening are parallel to each other.

9. The system of claim 1, wherein said threaded fastener includes a washer and a nut at a distalmost end to further secured said paver and said threaded fastener to said ground surface.

10. The system of claim 2, where said paver includes a connection surface extending about a perimeter of said paver.

11. The system of claim 10, wherein said connection surface includes angle cuts, said angle cuts at corners thereof, said angle cuts permitting said paver to be interconnected to additional of said paver to create said walkway.

12. The system of claim 1, wherein said lights are one of LED lights or light strips.

13. The system of claim 1, wherein a color or intensity of said lights is customizable.

14. The system of claim 10, wherein said connection surface is secured to said beams with connecting fasteners that extend therethrough.

* * * * *